US007254975B2

(12) United States Patent
Weschler

(10) Patent No.: US 7,254,975 B2
(45) Date of Patent: Aug. 14, 2007

(54) VEHICLE REPAIR CLAMPS

(76) Inventor: Bradley R. Weschler, 5 Skylark Ct., South Huntington, NY (US) 11746

( * ) Notice: Subject to any disclaimer, the term of this patent is extended or adjusted under 35 U.S.C. 154(b) by 0 days.

(21) Appl. No.: 10/898,440

(22) Filed: Jul. 23, 2004

(65) Prior Publication Data

US 2006/0016241 A1 Jan. 26, 2006

(51) Int. Cl.
*B21D 11/00* (2006.01)

(52) U.S. Cl. ..... 72/305; 72/311; 72/705

(58) Field of Classification Search ..... 72/295, 72/298, 299, 301, 302, 308, 310, 446, 447, 72/457, 705, 305, 311; 294/81.6, 81.61
See application file for complete search history.

(56) References Cited

U.S. PATENT DOCUMENTS

| | | | | | |
|---|---|---|---|---|---|
| 2,463,966 | A | * | 3/1949 | Hauschild | 72/301 |
| 2,725,917 | A | | 12/1955 | Kauppi | |
| 3,015,353 | A | * | 1/1962 | Brown | 72/302 |
| 3,131,747 | A | * | 5/1964 | Junkins | 72/457 |
| 3,241,352 | A | | 3/1966 | Lincourt | |
| 3,495,431 | A | * | 2/1970 | Landon | 72/302 |
| 3,526,120 | A | * | 9/1970 | Hunnicutt et al. | 72/302 |
| 3,610,022 | A | * | 10/1971 | Lincourt | 72/457 |
| 4,324,125 | A | | 4/1982 | Jarman et al. | |
| 4,457,159 | A | | 7/1984 | Jarman et al. | |
| 4,549,423 | A | * | 10/1985 | Masui | 72/295 |
| 4,718,266 | A | | 1/1988 | Jarman et al. | |
| 4,930,335 | A | | 6/1990 | Ishihara | |
| 5,267,465 | A | | 12/1993 | Gilman | |
| 5,730,019 | A | * | 3/1998 | Venalainen | 72/305 |
| 5,910,183 | A | * | 6/1999 | Ford et al. | 72/21.5 |
| 5,916,322 | A | * | 6/1999 | Venalainen | 72/457 |
| 5,943,902 | A | | 8/1999 | Ishihara | |

* cited by examiner

*Primary Examiner*—Ed Tolan
(74) *Attorney, Agent, or Firm*—Daniel P. Burke & Associates, PLLC

(57) ABSTRACT

Devices for straightening portions of a vehicle, particularly the unibody and/or frame of a vehicle following a collision. A device comprising a clamp which is attachable to a pulling device which exerts a pulling force in a direction P. The clamp comprises jaws which open in the general direction of pulling force P to engage a flange or other portion of a vehicle extending away from the direction of the pulling force P. This aspect is particularly useful for repairing the wheelhouse of a vehicle. Another aspect is a clamp with two openings, preferably in a single set of jaws. One opening may, for example, open proximally, i.e., in the general direction of pulling force P, while the other opening may open in a direction away from pulling force P. Another aspect of the present invention comprises providing a plurality of clamps in a single pulling device wherein the clamps are connectable, via a chain, to a single pulling arm, and where the clamps are independently positionable relative to each other. For example, the clamps can be rotated, twisted, extended and/or retracted independently of each other for connection to portions of a vehicle all of which can then be pulled in a single pulling step. Another aspect comprises a device having a plurality of clamps which allow portions of a vehicle to be pulled sequentially during a single pulling operation.

30 Claims, 14 Drawing Sheets

Fig.6
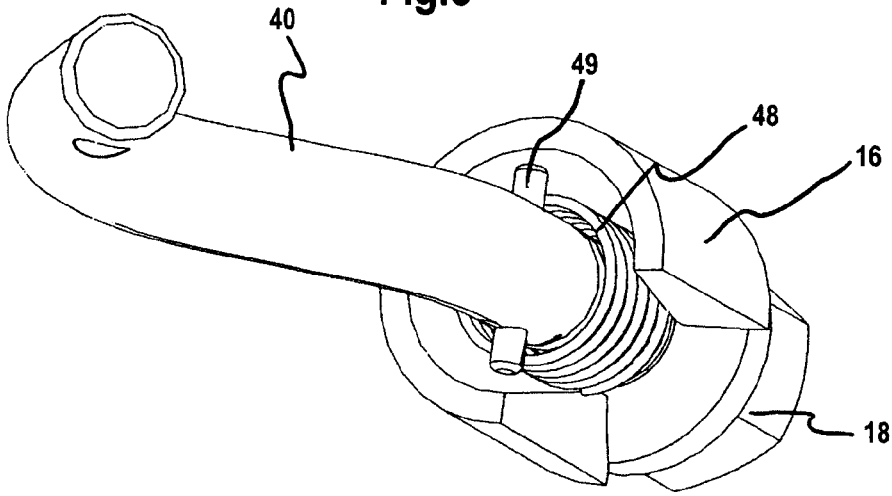
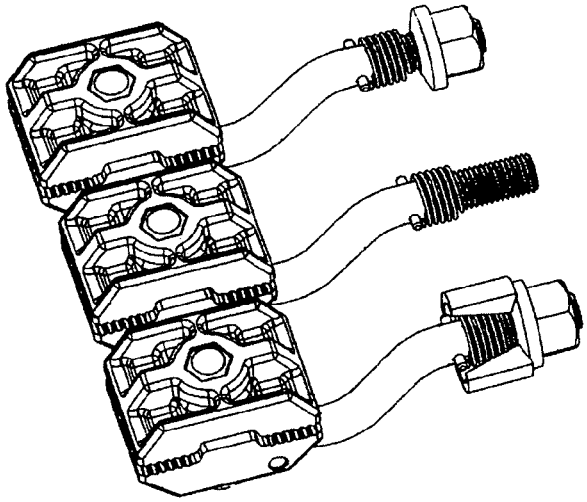
Fig.7
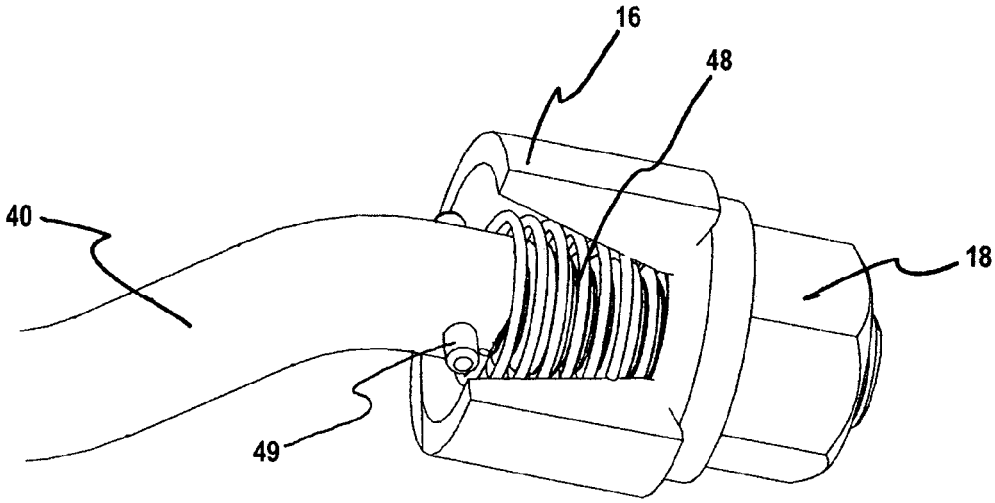
Fig. 8

VEHICLE REPAIR CLAMPS

The present invention relates to clamps used for connecting straightening devices to vehicle frames or uni-bodies. Specifically, the embodiments of the present invention comprise clamps adapted to grip portions of a vehicle having an edge extending away from the direction of the desired pull, such as a wheelhouse, clamps which are positionable at a wide variety of positions relative to the direction of a pulling force, and clamping devices comprising a plurality of clamps.

BACKGROUND OF THE INVENTION

When a vehicle has been in an accident, it is common for the frame, in the case of vehicles having a frame, or the unibody to be bent or deformed. It is well known that it is necessary to straighten the portions of the frame or unibody in order to affect an acceptable repair. As used herein in connection with repairing a damaged vehicle, the term "straighten" refers to returning one or more portions of a vehicle closer to its original configuration than the configuration it was in prior to starting the repair. The term "straighten" when used in this context does not necessarily indicate that the portion of the vehicle being repaired is made linear.

It is common in the vehicle repair industry to attach a powerful hydraulic straightening device to one or more portions of a vehicle utilizing a clamp which is attached directly to the vehicle and to a chain which connects the clamp to the straightening device. Certain portions of a vehicle have been inherently difficult to repair. For example, the wheelhouse of a vehicle typically comprises a curved portion, the edge of which extends inwardly, i.e. toward the center of the vehicle. In some instances, these edges comprise a welded seam of two sections of sheet metal.

Some previously known devices for pulling out a crushed wheelhouse comprise a curved bar which is designed to rest on top of the inwardly projecting edge and against the inner side of the wheelhouse. Such devices typically comprise structure which extends from the curved bar in the directions inwardly, downwardly, outwardly, and upwardly for attachment to the chain of a straightening device. These devices are maintained in position solely by outwardly directed forces applied manually during positioning and applied by the straightening device during the straightening procedure. Since such devices are not actually clamped onto the wheelhouse, they present a risk of slipping during positioning and during the straightening procedure. It would be more suitable, and particularly safer, to provide a more secure attachment between a clamp and the wheelhouse of a vehicle being required. It would also be desirable in some instances to be able to affect a straightening procedure using a single clamp which is attachable to different portions of a vehicle.

It would also be desirable to attach a single clamp to different portions of a vehicle for sequentially and/or simultaneously pulling those vehicle portions.

As used herein, the term "jaw" is used to indicate one side of the portion of the clamp which is used to grasp a portion of the vehicle. Thus, it will be understood that a clamp requires at least two jaws which are tightened onto a portion of a vehicle to which force will be exerted by the pulling device. In many accidents, closely positioned portions of a vehicle are damaged and it would be desirable to apply straightening forces during vehicle repair to multiple portions of a vehicle simultaneously and/or sequentially without having to reposition a clamp. It would, therefore, be desirable to provide a clamping device comprising one or more clamps capable of grasping multiple portions of a damaged vehicle.

SUMMARY OF THE INVENTION

The present invention is directed to devices for straightening portions of a vehicle, particularly the unibody and/or frame of a vehicle following a collision. One aspect of the present invention is directed to a device comprising a clamp which is attachable to a pulling device which exerts a pulling force in a direction P. The clamp comprises jaws which open in the general direction of pulling force P to engage a flange or other portion of a vehicle extending away from the direction of the pulling force P. This aspect of the present invention is particularly useful for attaching the clamp to the wheelhouse of a vehicle.

Another aspect of the present invention is providing a clamp with two openings, preferably in a single set of jaws. One opening may, for example, open proximally, i.e., in the general direction of pulling force P, while the other opening may open in a direction away from pulling force P which may or may not be opposite to pulling force P.

Another aspect of the present invention comprises providing a plurality of clamps in a single pulling device wherein the pulling device is connectable, e.g., via a chain, to a single pulling arm, and where the clamps are independently positionable relative to each other. For example, according to one preferred embodiment, the clamps can be rotated, angled, extended and/or retracted independently of each other for connection to portions of a vehicle all of which can then be pulled in a single pulling step. Another aspect of the present invention comprises a device having a plurality of clamps which allow portions of a vehicle to be pulled sequentially during a single pulling operation.

BRIEF DESCRIPTION OF THE DRAWINGS

FIG. 6 is a side perspective view of a connecting rod, tapered socket, adjustment nut, spring and spring retaining pin of the embodiment shown in FIG. 1.

FIG. 7 is a top perspective view of the device shown in FIG. 1 with portions removed to illustrate the cooperative relationship between the connecting rod, tapered socket, adjustment nut, spring and spring retaining pin.

FIG. 8 is a close-up view of the adjustment nut, tapered socket, spring and spring retaining pin, and a portion of a connecting rod of the embodiment shown in FIG. 1.

DETAILED DESCRIPTION

Figure 1:
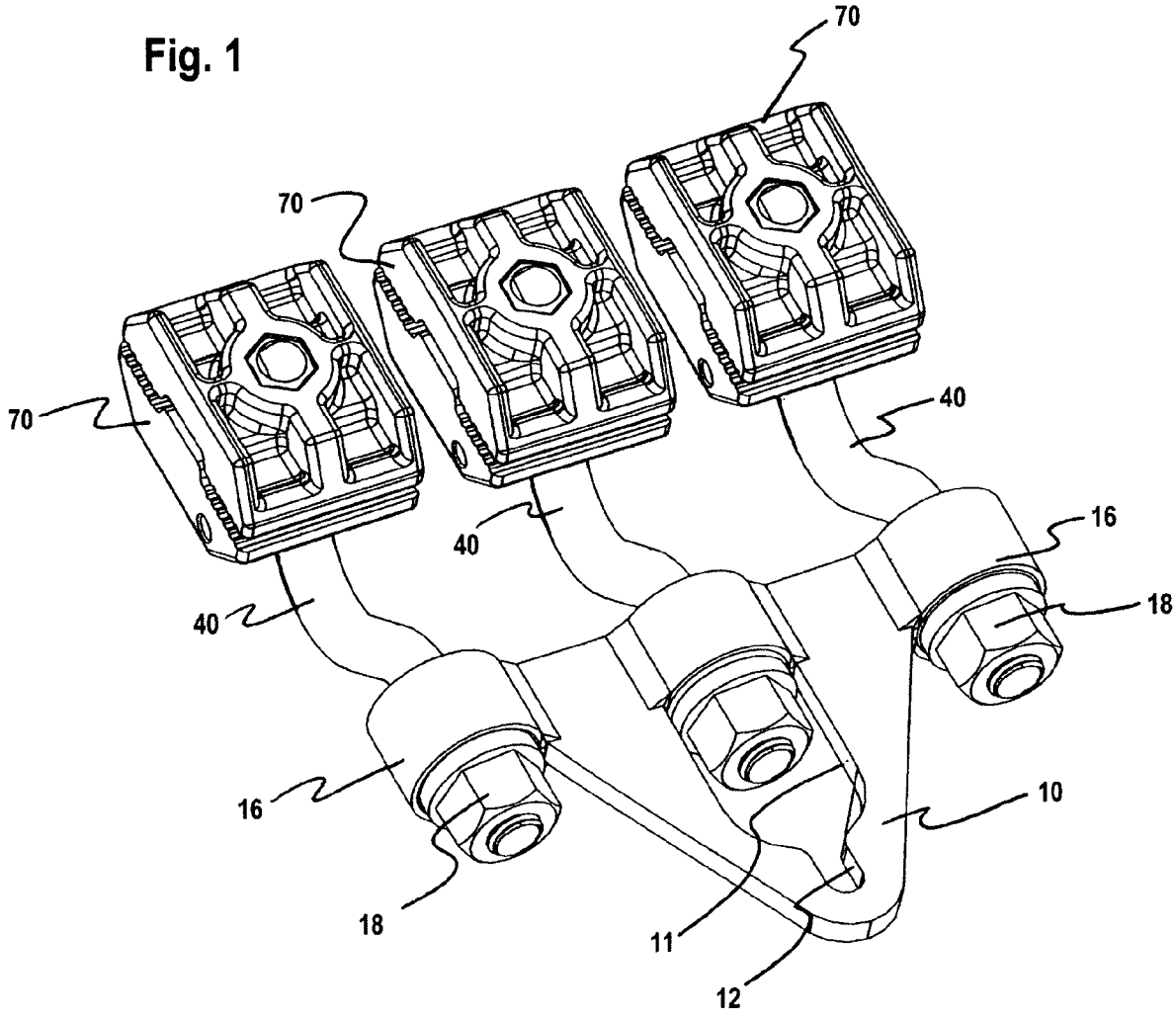
FIG. 1 is a top perspective view of one embodiment of the present invention.

FIG. 1 illustrates one embodiment of the present invention comprising a yoke 10, three connector rods 40 and three corresponding clamps 70. In this illustrated embodiment of the present invention, yoke 10 is capable of receiving up to three connector rods. While the use of a yoke with up to three clamps will be suitable for many applications, it is also within the scope of the present invention to provide yokes or other structures capable of connection with fewer or a greater number of clamps.

Illustrated yoke 10 comprises a generally key shaped slot 11 designed to receive a chain (not shown) with the small proximal portion 12 of the slot 11 designed to secure the chain to yoke 10. Other openings and other manners of attaching a chain or other portion of a straightening device may be utilized without the departing from the scope of the present invention. Those skilled in the art have knowledge regarding how to attach a pulling device to a clamping device so no further explanation or illustration of a pulling device is set forth herein.

Figure 2:
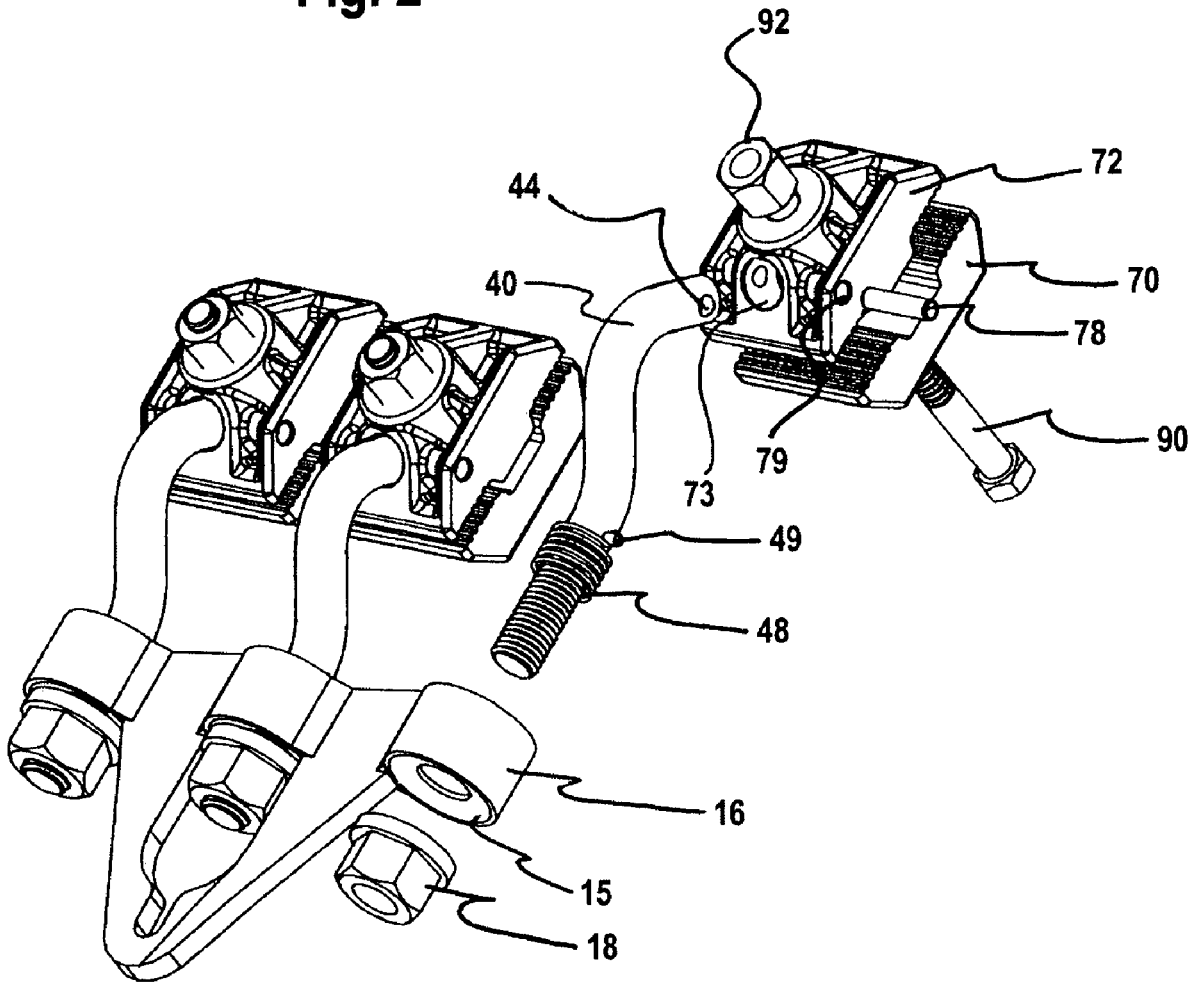
FIG. 2 is a bottom perspective, partially exploded view of the embodiment shown in FIG. 1.
Figure 3:
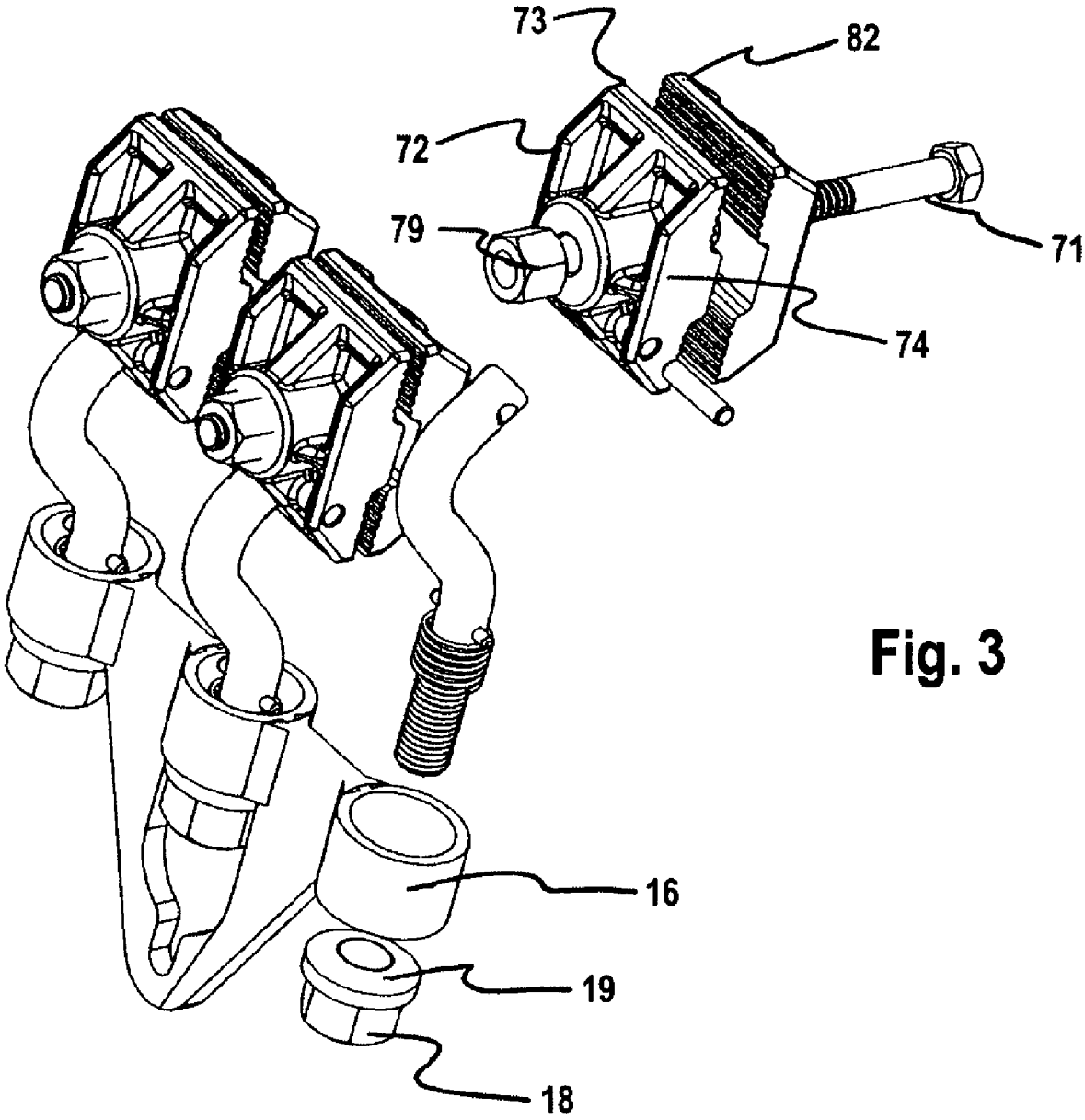
FIG. 3 is a side perspective, partially exploded view of the embodiment shown in FIG. 1.

FIGS. 2 and 3 are exploded bottom perspective and side perspective views of the embodiment shown in FIG. 1. With reference to FIG. 2, each clamp 70 comprises a tightening bolt 90 which engages a clamp nut 92. Each connecting rod 40 is provided with a through hole 44 positioned near the distal end of the rod 40. The connecting rod 40 is connected to a clamp 70 by inserting the distal end of the connecting rod 40 into a bore 73 in bottom jaw 72 of clamp 70 and inserting pin 78 through the side of jaw 72 and through bore 44 of connecting rod 40. The dimensions of pin 78 and through hole 79 in jaw 72 and through hole 44 in connecting rod 40 advantageously provide an interference fit so that pin 78 will remain in place during typical pulling operations keeping clamp 70 attached to connecting rod 40 when desired. However, if and when it is desired to disassemble connecting rod 40 from clamp 70, pin 78 can be removed using a punch. This facilities repair and replacement, as well as the use of different connecting rods with a single clamp, if desired. It is also within the scope of the present invention to provide other types of removable connections between connecting rod 40 and clamps 70, or to provide a permanent connection, for example by welding, or by integrally forming jaws 72 with connecting rod 40.

Figure 5:
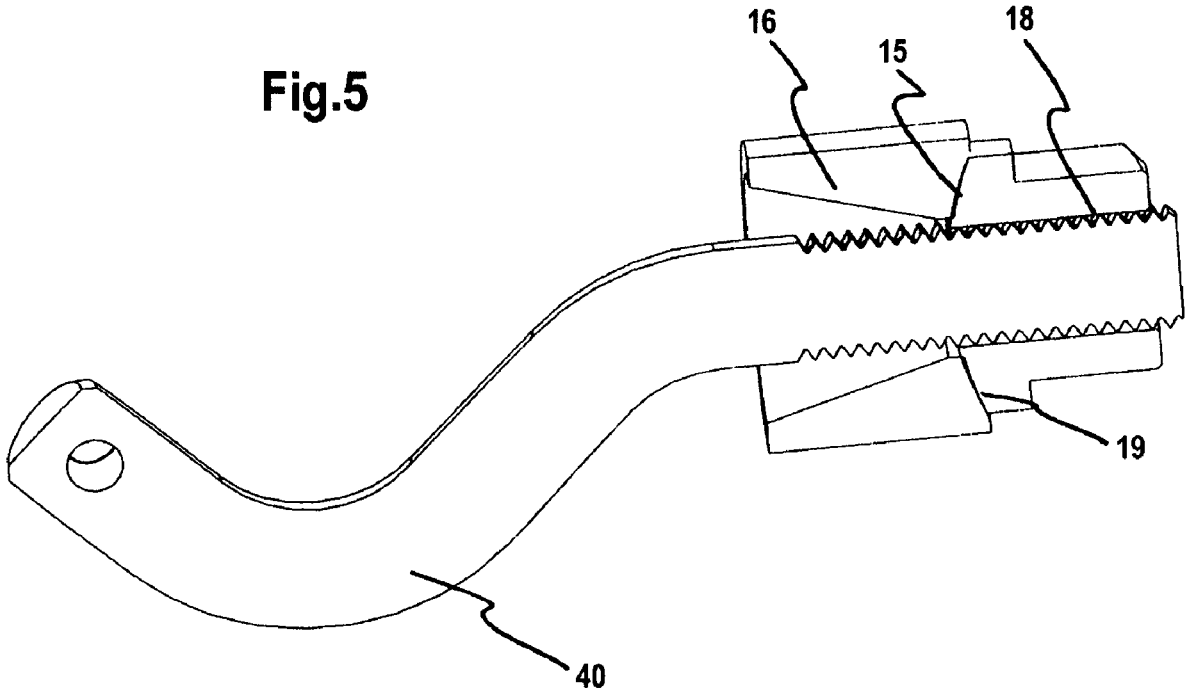
FIG. 5 is a cross sectional view of a connecting rod, tapered socket and adjustment nut of the embodiment shown in FIG. 1.

The proximal end of connecting rod 40 comprises a threaded section 42 which facilities attachment to yoke 10 through a socket 16 utilizing an adjustment nut 18. Each receptacle of this illustrated embodiment comprises a conically tapered socket 16 and an adjustment nut 18. The extent to which the connecting rods extend from the yoke 11 can be adjusted by the loosening and tightening of the hexagonal nuts 45. FIG. 5 is a cross-sectional view showing connecting rod 40 passing through tapered socket 16 and threadably received in adjustment nut 18. For certain applications and straightening procedures, it may be desirable to dispose the connecting rods at an angle to the yoke. The preferred illustrated arrangement provides a degree of angular adjustability of each clamp 70 relative to yoke 10. The proximal portion of connecting rod 40 is designed to fit somewhat loosely within tapered socket 16 in order to permit the connecting rod 40, and attached clamp 70, to move relative to socket 16 as shown in FIGS. 2, 3, and 5. The conical taper 16 in each receptacle 15 of this illustrated embodiment also provides some room for the connecting rod to be disposed at different angles relative to the yoke 10. The proximal surface 15 of socket 16 is generally concave and rounded and the distal end of adjustment nut 18 is correspondingly convex and rounded to facilitate the relative movement of the adjustment nut 18 relative to the socket 16. From the present description and drawings those skilled in the art will appreciate that when a clamping device is being attached to the damaged portion of a vehicle, it may be desirable to slightly adjust the position of one or more clamps or to adjust the distance between clamps.

While this configuration of the receptacle is preferred for reasons described below, other configurations are also useful with the present invention. For example, the receptacle can simply be a bore, for example, a circular cylindrical bore. Alternatively, the bore could be threaded with threads corresponding to threads on a connecting rod, though this would eliminate some of the versatility of the illustrated embodiment. While the illustrated configuration of hexagonal nut 45 with the tapered crown 46 with connecting rods 40 provide suitable connections between clamps 70 and yoke 11, other connections can be used.

FIG. 1 also illustrates three connecting rods 40 which movably connect clamps 70 with yoke 10. The illustrated rods are provided in a generally C-shape to facilitate substantial alignment of the portion of a vehicle being secured within the jaws with the plane of the yoke 10 when the jaws are in the configuration shown in FIG. 1 and/or with the pulling force. From the description provided below, it will be appreciated that the portion of the vehicle which is grasped by the jaws is not necessarily in the same plane as the yoke or the direction of pulling force applied by the straightening device. In certain instances, however, it is most desirable to have the pulling force aligned and/or in the same plane as a portion of a vehicle which is being straightened.

According to another aspect of the preferred, illustrated embodiment, in order to prevent the clamps 70 and connecting rods 40 from flopping around loosely during the positioning of the jaws on the vehicle, a coil spring 48 is positioned between the proximal end of the conically tapered receptacle 16 and a spring retaining pin 49 positioned through the connecting rod 40. Spring 48 permits movement of the jaws and connecting rods relative to the yoke but is preferably strong enough to maintain the connecting rods in one position in the absence of manual force applied to the clamps 70. FIGS. 6, 7, and 8 illustrate the positioning of the coil spring 48 between spring retaining pin 49 and tapered socket 16. Other devices, could be used for preventing undesired movement of the jaws relative to the yoke during set up for a straightening procedure.

Figure 4:
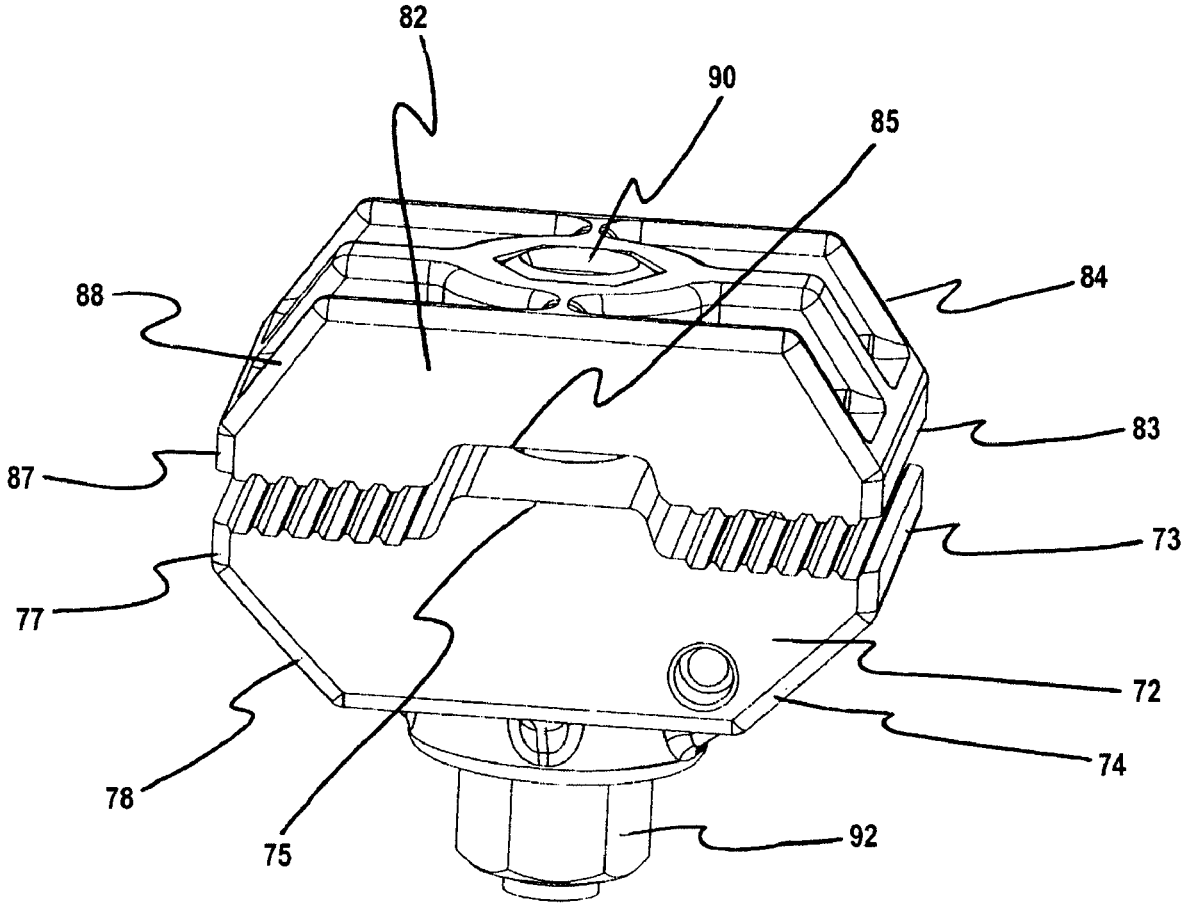
FIG. 4 is a side perspective view of the clamp shown in FIG. 1.

As shown in FIGS. 3-5, each clamp 70 preferably comprises a lower jaw 72 and an upper jaw 82 which are tightened by a throughbolt 90 which cooperates with clamp nut 92. The use of the terms "lower" and "upper" are for reference only and are not intended to limit the manner or positions in which the clamps can be attached to a vehicle. In this illustrated embodiment, throughbolt 90 is preferably received within a hexagonal recess in upper jaw 82 when throughbolt 90 is inserted all the way into upper jaw 82. In this manner, the clamp can be tightened simply by turning clamp nut 92.

With reference to FIG. 4, the illustrated clamps 70 are each advantageously provided with proximal edge 73, 83 respectively and a beveled portion 74, 84. For example, the height of edges 73, 83 may be about ¼ inch to about ½ inch, while the height of one entire jaw could be about ½ inch to about 3 inches. This configuration permits the jaws to be abutted up against confined areas, such as the wheelhouse of a vehicle. The distal end of the illustrated jaws have a similar configuration including edges 77, 87 and angled distal sides 78 and 88 of lower jaw 72 and upper jaw 82, respectively. The working portion of each jaw is preferably provided with ridges or is knurled in order to facilitate secure attachment between the jaws and the portion of the vehicle being grasped and to minimize the risk of slippage.

The illustrated lower jaw 72 is provided with a ridge 75 which is matingly received within a corresponding recess 85 in upper jaw 82. This arrangement is provided to minimize any potential relative movement between the lower jaw 72 and upper jaw 82. As will be described in further detail below, the clamps 70 are designed for attachment at either their proximal section, distal section, or if warranted by a specific application, at both sections.

Figure 9:
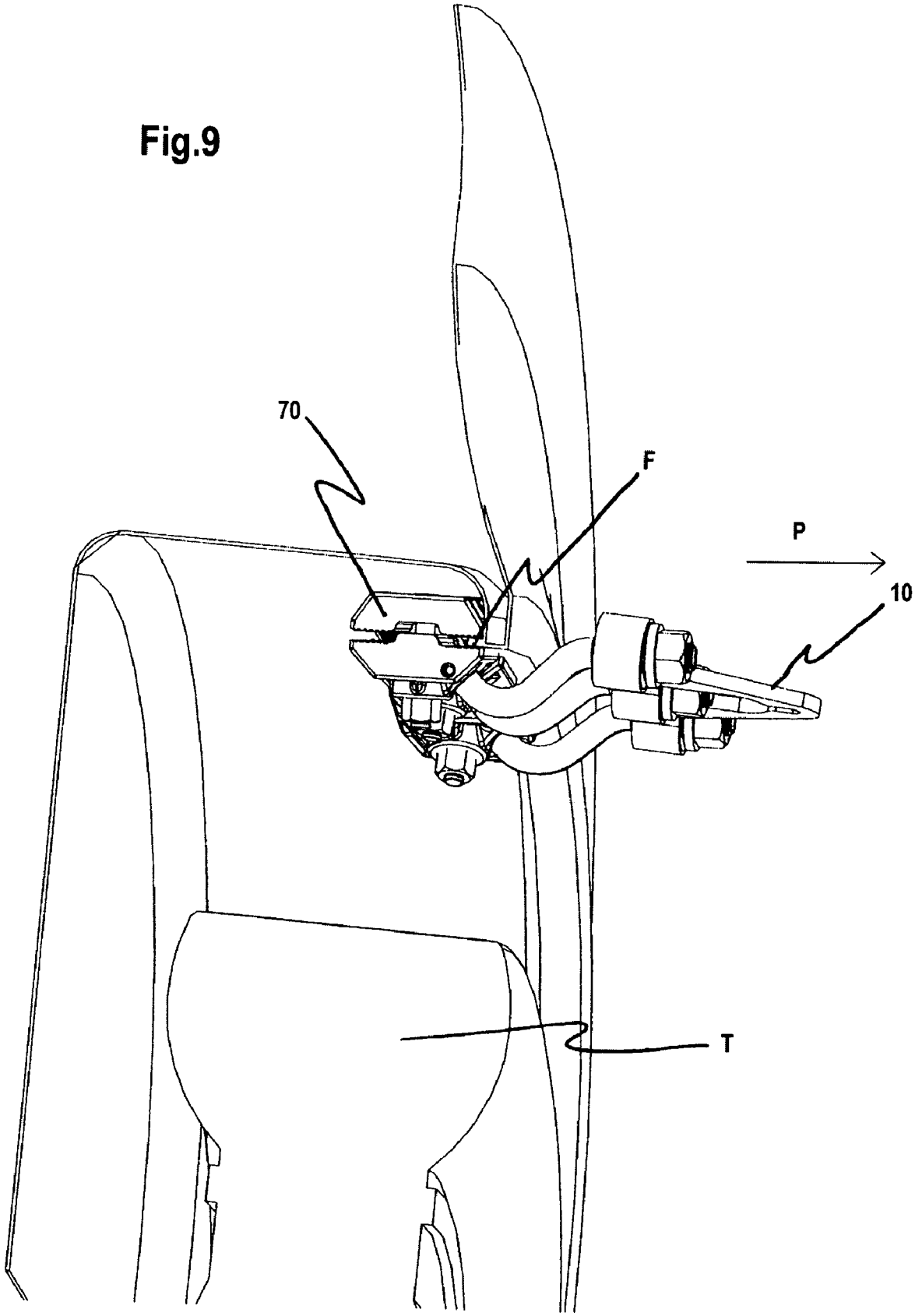
FIG. 9 is a side perspective view of the clamping device shown in FIG. 1 attached to a wheelhouse of a vehicle.
Figure 12:
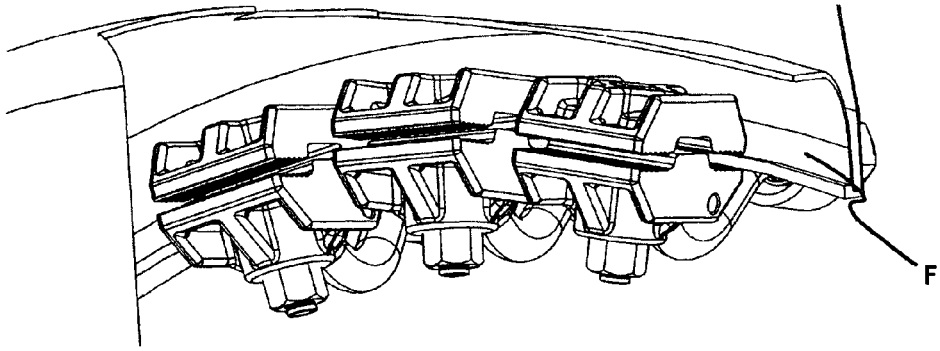
FIG. 12 is a close-up distal, perspective view of the arrangement shown in FIG. 9 with the clamps attached to a wheelhouse.
Figure 10:
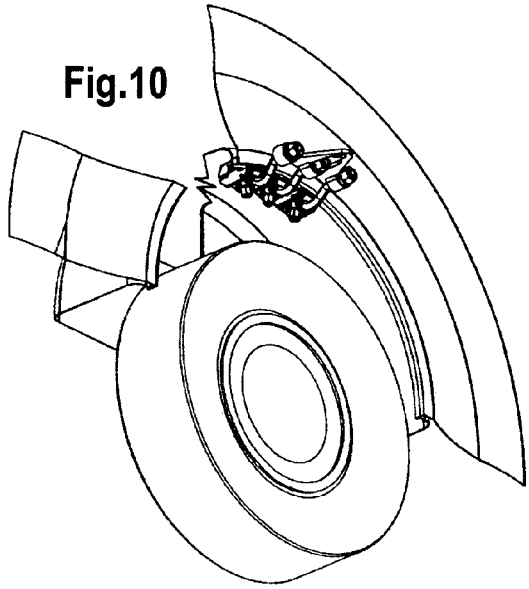
FIG. 10 is a bottom, side perspective view of the arrangement shown in FIG. 9.
Figure 11:
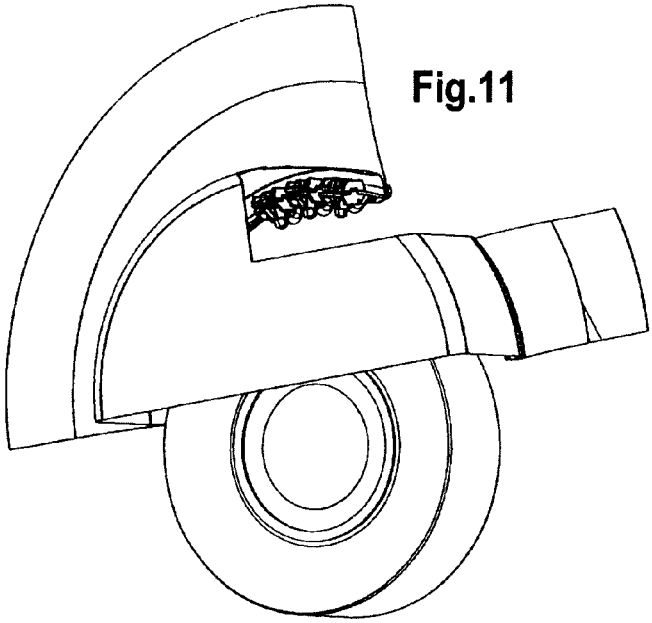
FIG. 11 is a distal, perspective view of the arrangement shown in FIG. 9.

FIGS. 9-12 illustrate the attachment of the clamp shown in FIGS. 1-8 to the wheelhouse of a vehicle. As shown in FIG. 9, the clamps 70 are secured to a flange F above tire T in a wheelhouse of a vehicle. The pulling force P exerted on the yoke 10 will pull the portions of the wheelhouse generally in the direction of force P. From the present description, those skilled in the art will appreciate that the proximal opening of the jaws of clamp 70 as well as the relatively narrow proximal surfaces 73, 83 and beveled portions 74, 84, of lower jaw 72 and upper jaw 82, respectively (as shown in FIG. 4) facilitate the positioning of clamps 70 in a vehicle wheelhouse. As best shown in FIG. 12 which is a perspective, distal end view of the clamps 70 clamped onto flange F, the rotatability of the connecting rods 40 relative to yoke 10 permits each of the clamps 70 to be positioned at a different angle relative to the yoke and thereby facilitates attachment of this illustrated clamping device to a non-linear surface such as the flange F of a wheelhouse. With reference again to FIG. 9, it can be appreciated that the generally curved shape of connecting rods 40 also permits the pulling force P to be directed close to or on the actual plane of the vehicle portion being pulled. FIGS. 10 and 11 are bottom perspective and distal perspective use of the views shown in FIGS. 9 and 12.

Figure 14:
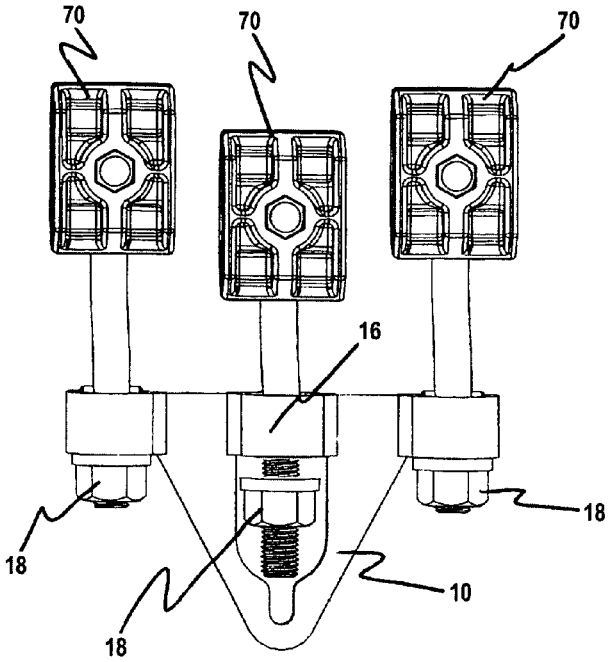
FIG. 14 is a top view of the device shown in FIG. 1.
Figure 13:
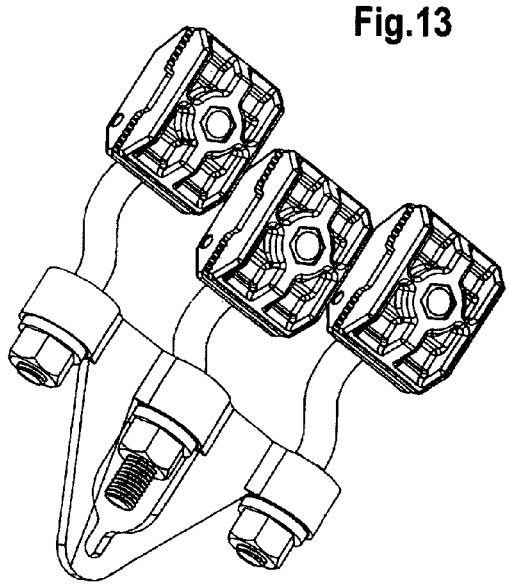
FIG. 13 is a top, perspective view of the device shown in FIG. 1.
Figure 15:
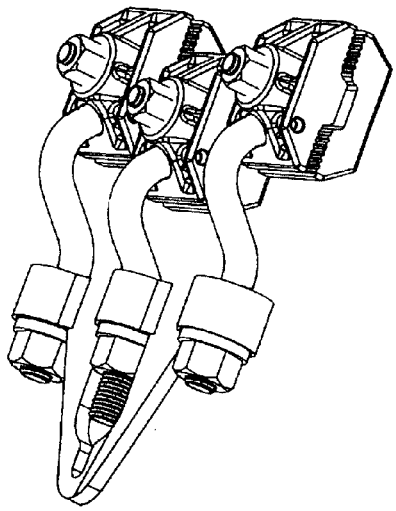
FIG. 15 is a bottom, perspective view of the device shown in FIG. 1.

FIGS. 13, 14, and 15 illustrate another aspect of the present invention wherein the clamps of a single pulling device can be utilized to pull separate portions of a damaged vehicle sequentially. The clamps can be attached to vehicle portions in a manner whereby a pulling force exerted on the yoke will move one or more portions of the vehicle which is attached to a first clamp a predetermined distance before starting to move another portion of the damaged vehicle to which a separate clamp is attached. This aspect of the present invention is particularly useful when proximately positioned portions of a vehicle are deformed to a different extent and do not require the same degree of movement to affect the desired repair. In the arrangement illustrated in FIG. 14, outer clamps 70 can be attached to a damaged vehicle portion and their respective adjustment nuts 18 are tightened snugly against the distal surface 15 of socket 16. The adjustment nut 18 on the center connecting rod is not tightened but is positioned a pre-determined distance down the threaded proximal portion of the center connecting rod. When the clamp 70 is connected to the damaged portion of a vehicle in this arrangement and a pulling force is exerted on yoke 10, the portions of the vehicle to which the outer clamps 70 have been secured will be moved simultaneously with yoke 10, however, the portion of the vehicle to which center clamp 70 is attached will not move until the center socket 16 has moved sufficiently to engage center adjustment nut 18. While this figure illustrates one arrangement for sequential repair of a vehicle, from the present description those skilled in the art will appreciate that any other arrangements for sequential pulling can be performed within the scope of the present invention. For example, yokes having a greater number or fewer clamps can be provided within the scope of the present invention. Of course, the various embodiments of the present invention also permit simultaneous movement of different damaged portions of a vehicle.

From the present description, it will be appreciated that each of the clamp 70 is independently positionable. Thus, each connecting rod 40 can be rotated independently of the other connecting rods 40. Additionally, each jaw can be extended a different distance from the yoke 10. The present invention permits sequential and/or simultaneous movement of different damaged portions. It is believed that the embodiments of the present invention are safer for the technicians and also provide greater versatility to the technician while straightening damaged portions, such as a wheelhouse, of a vehicle.

Figure 16:
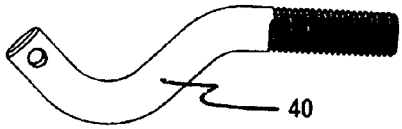
FIG. 16 is a side, perspective view of the connecting rod used in the embodiment of FIG. 1.
Figure 17:
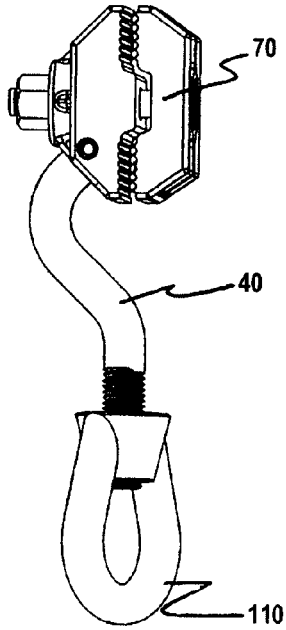
FIG. 17 is a side, perspective view of an alternative embodiment of the present invention.
Figure 19:
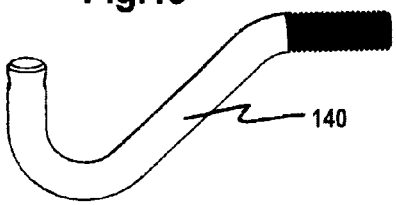
FIG. 19 is a top perspective view of an alternative embodiment of the present invention.
Figure 20:
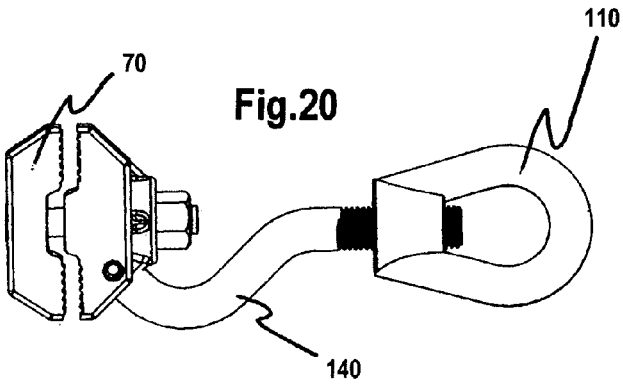
Figure 18:
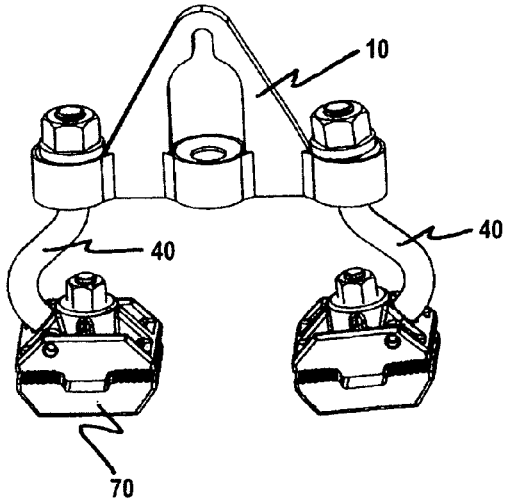
FIG. 18 is a side, perspective view of an alternative connecting rod of the present invention.

According to another aspect of the present invention, different shaped connector rods can be used with different yokes. FIG. 16 is a side view of the connector rod 40 shown in the embodiment of FIG. 1. Connector rod 40 can be used with a single eye bolt 110 and clamp 70 as shown in FIG. 17 or with yokes which support greater number of clamps such as is shown in FIG. 18. While the non-threaded portion of connector rod 40 has a generally continuous curved shape similar to a letter "C", the connector rod 140 shown in FIG. 19 is generally J-shaped. When connector 140 is used with eye bolt 110 or yoke 10 and clamps 70, the resulting pulling devices shown in FIGS. 20 and 21 permit the attachment to varied vehicle portions. It is also within the scope of the present invention to use different shaped connecting rods in the same pulling device. While two shapes of connecting rods have been illustrated, it is also within the scope of the present invention to use other configurations of connecting rods.

Figure 22:
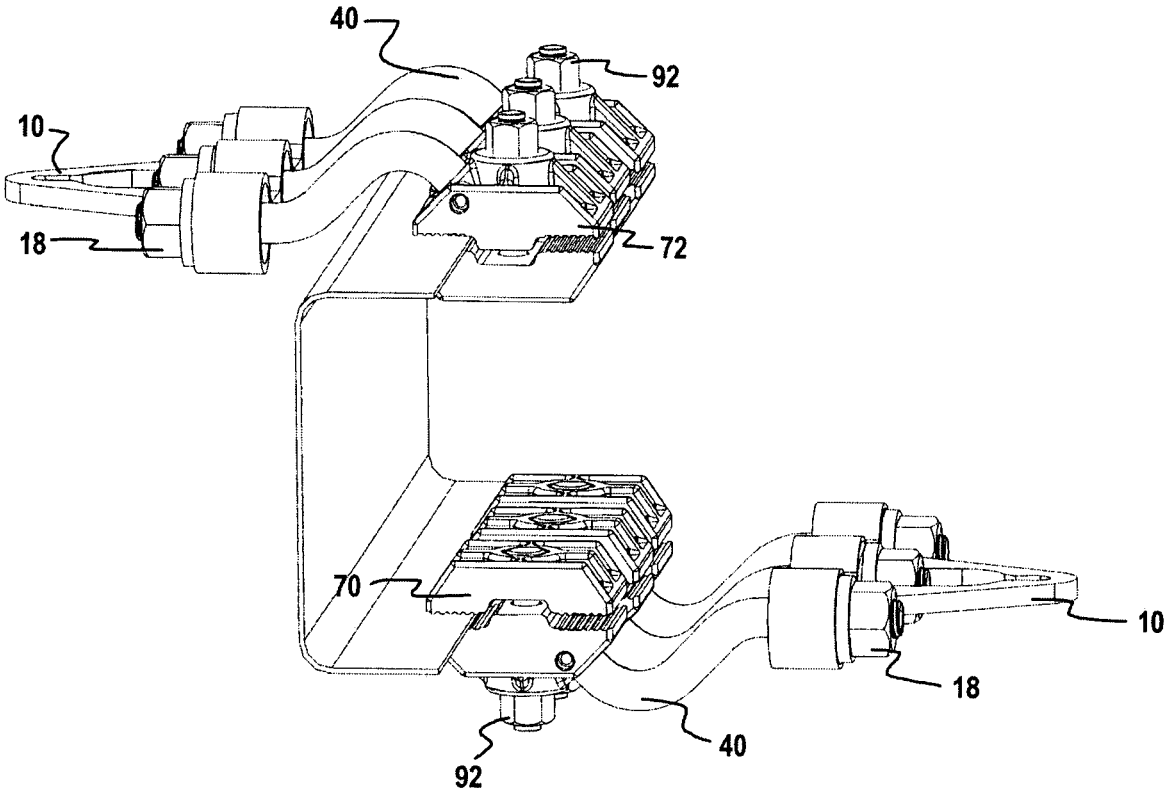
FIG. 22 illustrates different ways in which the embodiment shown in FIG. 1 can be connected to portions of a vehicle.

FIGS. 22-25 illustrate different manners in which clamping devices of present invention can be attached to portions of a vehicle. The illustrated vehicle portions in FIGS. 22-25 are hypothetical and are provided merely for illustration. As illustrated in FIG. 22 the upper clamp is attached utilizing the proximal jaws of clamps 70 while the lower clamp is attached using the distal jaws of clamps 70.

Figure 23:
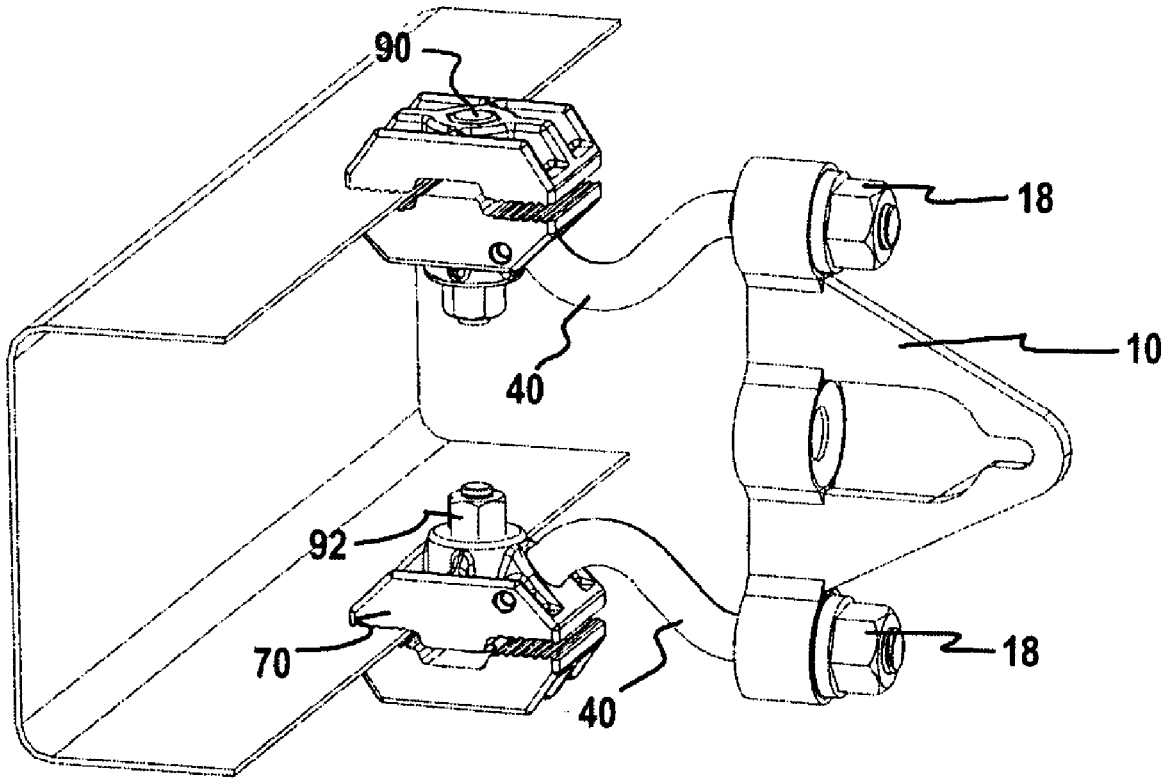
FIG. 23 illustrates a further manner of connecting the embodiment shown in FIG. 1 to a portion of a vehicle.

FIG. 23 illustrates use of less than all possible clamps with a single yoke wherein the clamps have been rotated to support different ends of a channel. In this illustrated embodiment, each jaw is grasping one side of a channel-shaped structure of a vehicle, however, it is within the scope of the present invention to have one jaw grasping one portion of a vehicle and another jaw grasping a second portion of a vehicle which is not directly connected to the first portion.

Figure 21:
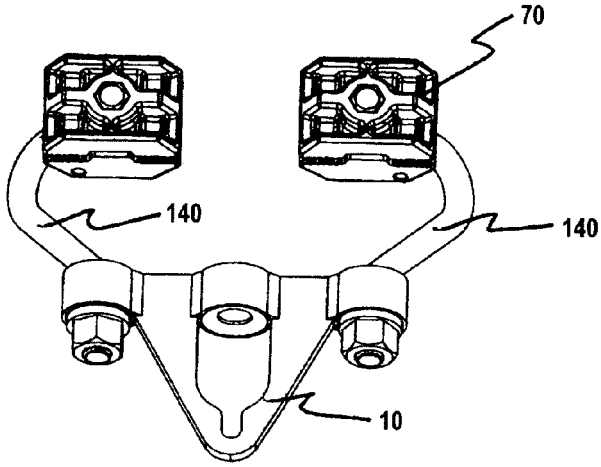
FIGS. 20 and 21 are top and side, perspective views of an alternative embodiment of the present invention.
Figure 24:
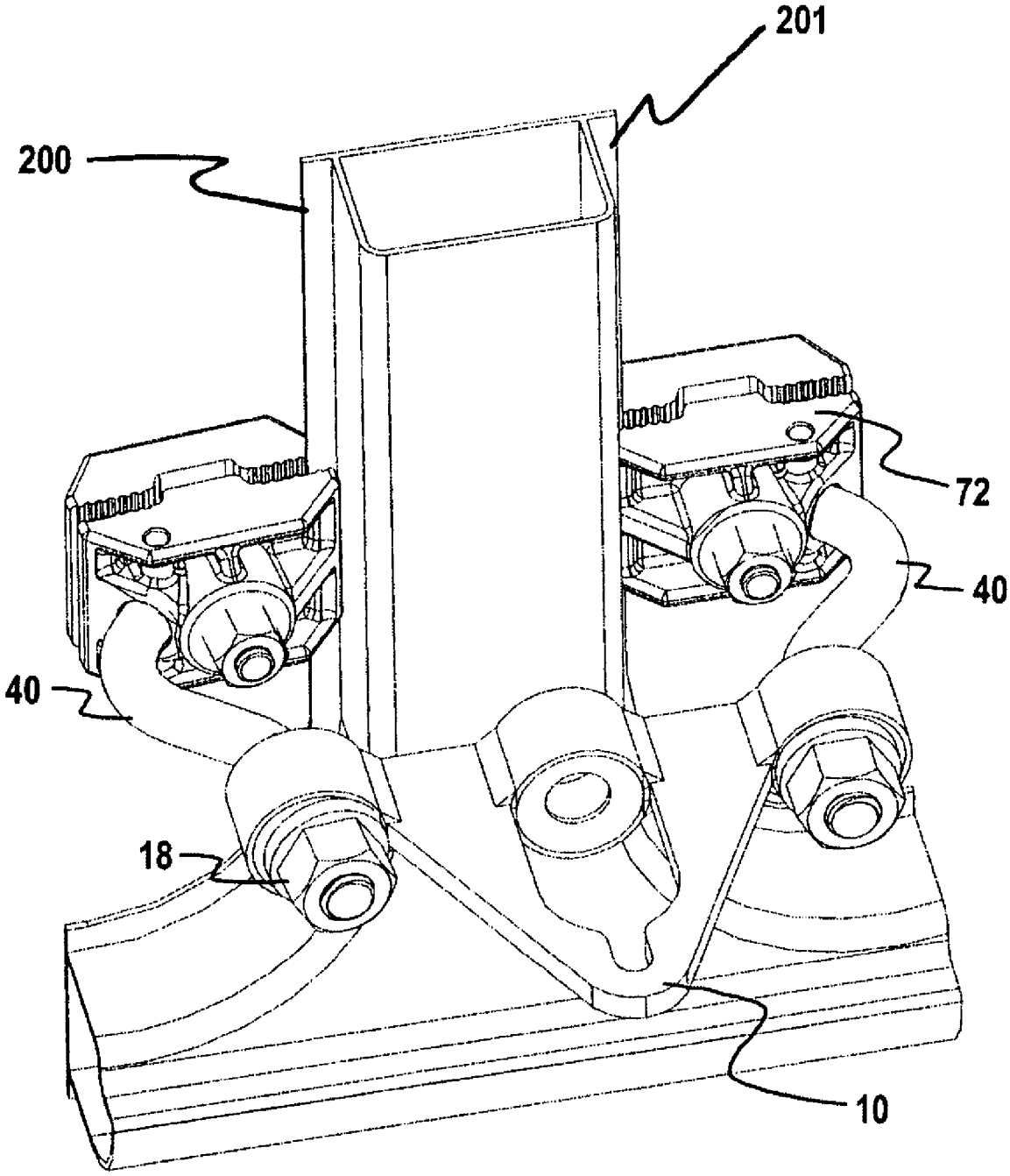
FIG. 24 illustrates an alternative embodiment and illustrates how this embodiment could be connected to a vehicle portion.

FIG. 24 illustrates use of the clamping device shown in FIG. 21 attached to separate flanges 200, 201 of a vehicle portion.

Figure 25:
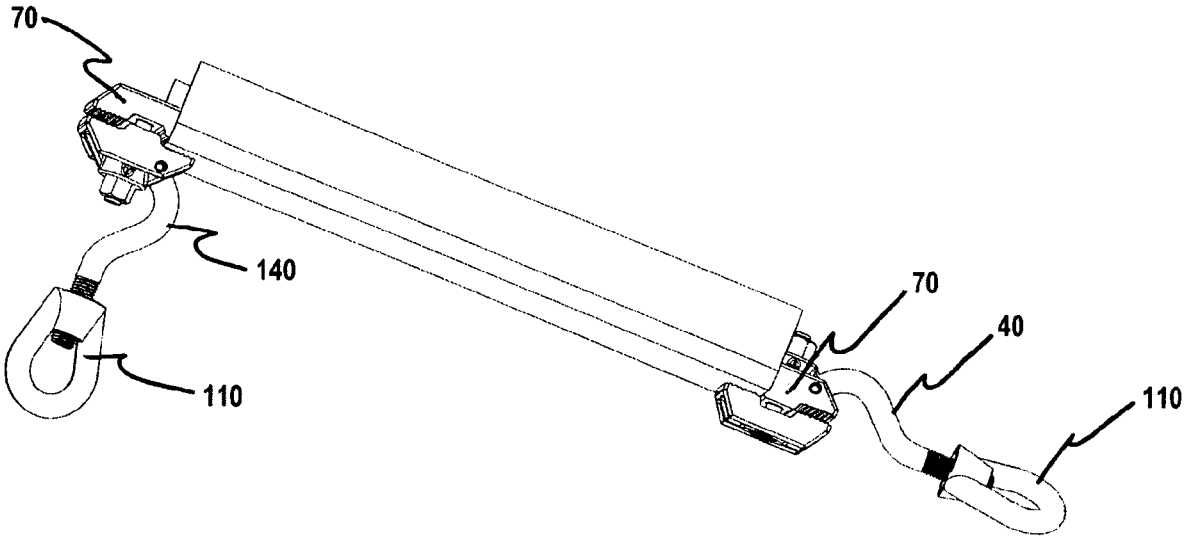
FIG. 25 illustrates an attachment of alternative embodiments of the present invention.

FIG. 25 illustrates the use of pulling devices of the present invention which each comprise a single clamp.

From the present invention it will be understood that other arrangements can be accomplished within the scope of the present invention.

The invention claimed is:

1. A vehicle repair device comprising:

a plurality of clamps each of said clamps, comprising at least one pair of jaws;

means for connecting said clamps to a single pulling device;

wherein said clamps are independently movable relative to said connecting means.

2. A vehicle repair device according to claim 1 wherein said connecting means comprises a yoke.

3. A vehicle repair device according to claim 2 wherein each of said clamps is connected to said yoke with a connecting rod.

4. A vehicle repair device according to claim 3 wherein at least one of said connecting rods is non-linear.

5. A vehicle repair device according to claim 3 wherein at least one of said connecting rods is generally C-shaped.

6. A vehicle repair device according to claim 3 wherein at least one of said connecting rods is generally J-shaped.

7. A vehicle repair device according to claim 1 wherein each of said jaws comprises a generally planar gripping region when closed on a piece of sheet metal, and wherein at least two of said gripping regions are selectively positionable in different planes.

8. A vehicle repair device according to claim 1 wherein the distance between said clamps and said connecting means is selectively adjustable.

9. A vehicle repair clamping device comprising:

at least one clamp comprising at least one pair of jaws;

said clamp comprising a proximal end and a distal end;

means for connecting said clamp to a pulling device which exerts a force in a general direction comprising a generally proximal component;

said jaws comprising a selectively closeable proximal opening, wherein said proximal opening opens to receive a portion of a vehicle extending in a direction generally opposite to the direction of said pulling force.

10. A vehicle repair clamping device according to claim 9 wherein said clamping device comprises a plurality of clamps.

11. A vehicle repair clamping device according to claim 10 wherein said clamping device comprises at least three clamps.

12. A vehicle repair device comprising:

at least one clamp;

means for connecting said clamp to a straightening device for exerting a pulling force on said clamp in a pulling direction;

said clamp comprising at least one pair of jaws, said jaws comprising a first opening which substantially opens in said pulling direction to receive a portion of a vehicle extending in a direction generally opposite to the direction of said pulling force.

13. A vehicle repair device according to claim 12 wherein said clamp comprises jaws comprising a second opening which is substantially parallel to said pulling direction.

14. A vehicle repair device according to claim 12 wherein said clamp also comprises jaws which open generally away from said pulling direction.

15. A vehicle repair device according to claim 12 wherein said clamp also comprises jaws which open generally opposite to said pulling direction.

16. A vehicle repair device according to claim 12 wherein said clamp comprises at least one pair of jaws comprising two openings which open in a first direction and a second direction.

17. A vehicle repair device according to claim 16 wherein said openings are in the same plane as said pulling force.

18. A vehicle repair device according to claim 16 wherein said first direction is substantially opposite to said second direction.

19. A vehicle repair device according to claim 16 wherein said first direction and said second direction are substantially parallel to said pulling direction.

20. A vehicle repair device according to claim 18 wherein said first direction and said second direction are in substantially the same plane as to said pulling direction.

21. A vehicle repair device according to claim 12 wherein said clamp is movably connected to said connecting means.

22. A vehicle repair device according to claim 12 comprising a plurality of clamps.

23. A vehicle repair device according to claim 22 wherein said clamps are movably connected to said connecting means.

24. A vehicle repair device according to claim 22 wherein said clamps are independently movable.

25. A vehicle repair device according to claim 22 wherein said clamps are independently adjustable for attachment to vehicle portions which are spaced from said connecting means by different distances.

26. A vehicle repair device according to claim 25 wherein said clamps are independently adjustable for attachment to vehicle portions such that the openings of said clamps can be disposed at different angles.

27. A vehicle repair device according to claim 22 wherein said clamps are independently adjustable for attachment to vehicle portions such that the openings of said clamps can be disposed at different angles.

28. A vehicle repair device according to claim 22 wherein said clamps are independently adjustable for attachment to vehicle portions wherein at least one of said clamps is not subject to a pulling force when said connecting means is initially moved by a straightening device.

29. A vehicle repair device according to claim 28 wherein said clamps are independently adjustable for attachment to vehicle portions wherein a plurality of said clamps each first experience a pulling force at different times during a single pull by a straightening device.

30. A vehicle repair device according to claim 12 wherein said opening is in the same plane as said pulling force.

* * * * *